US012631074B2

(12) United States Patent
Gastardelli et al.

(10) Patent No.: US 12,631,074 B2
(45) Date of Patent: May 19, 2026

(54) DEPLOYMENT OF UMBILICAL WITH TUBULAR STRING

(71) Applicant: WEATHERFORD TECHNOLOGY HOLDINGS, LLC, Houston, TX (US)

(72) Inventors: Bruno Gastardelli, Macaé (BR); Leonidas Ferrarini, Jr., Curitiba (BR); Matheus Spinelli, Macaé (BR)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 339 days.

(21) Appl. No.: 18/253,106

(22) PCT Filed: Dec. 16, 2020

(86) PCT No.: PCT/US2020/065225
§ 371 (c)(1),
(2) Date: May 16, 2023

(87) PCT Pub. No.: WO2022/132140
PCT Pub. Date: Jun. 23, 2022

(65) Prior Publication Data
US 2023/0417112 A1 Dec. 28, 2023

(51) Int. Cl.
*E21B 19/087* (2006.01)
*E21B 17/02* (2006.01)

(52) U.S. Cl.
CPC ..... *E21B 19/087* (2013.01); *E21B 17/026* (2013.01)

(58) Field of Classification Search
CPC ..... E21B 19/087; E21B 17/026
See application file for complete search history.

(56) References Cited

U.S. PATENT DOCUMENTS 6,920,931 B1 7/2005 Webre et al.
7,249,637 B2 * 7/2007 Hayes ..... E21B 19/20 166/380

(Continued)

FOREIGN PATENT DOCUMENTS

WO 2005071215 A1 8/2005
WO 2009022912 A1 2/2009

OTHER PUBLICATIONS

Brazilian Office Action issued Apr. 24, 2025 for BR Patent Application No. 1120230117704, 4 pages.

(Continued)

*Primary Examiner* — Tara Schimpf
*Assistant Examiner* — Daniel T Craig
(74) *Attorney, Agent, or Firm* — Smith IP Services, P.C.

(57) ABSTRACT

An apparatus can include a telescoping arm having a guiding means and a pivot at opposite ends, the telescoping arm being rotatable about the pivot relative to a spider, and the pivot being secured to the spider. A method can include extending a telescoping arm upward relative to a rig floor, pivoting an upper end of the telescoping arm toward a tubular string, then clamping an umbilical to the tubular string, then lowering the tubular string, then retracting the telescoping arm and pivoting the upper end of the telescoping arm away from the tubular string, and then applying torque to a connection in the tubular string. A system can include an actuator operative to rotate a telescoping arm about a pivot, an upper end the actuator is connected to the telescoping arm, and a lower end of the actuator is positioned within an outer circumference of a spider.

19 Claims, 6 Drawing Sheets

(56) References Cited

U.S. PATENT DOCUMENTS

| | | | | |
|---|---|---|---|---|
| 7,337,853 | B2 | 3/2008 | Buytaert et al. | |
| 7,367,403 | B2 | 5/2008 | Webre et al. | |
| 7,610,965 | B2 | 11/2009 | Pennison et al. | |
| 7,703,540 | B2 | 4/2010 | Webre et al. | |
| 8,191,641 | B2 | 6/2012 | Boutwell, Jr. et al. | |
| 8,225,875 | B2 | 7/2012 | Begnaud et al. | |
| 8,863,822 | B2 | 10/2014 | Boutwell, Jr. et al. | |
| 9,938,780 | B2 | 4/2018 | Begnaud | |
| 2006/0065407 | A1* | 3/2006 | Rufey | E21B 19/12 166/384 |
| 2012/0090828 | A1 | 4/2012 | Webre et al. | |
| 2020/0165879 | A1 | 5/2020 | Wijning et al. | |

OTHER PUBLICATIONS

English Translation of Brazilian Office Action issued Apr. 24, 2025 for BR Patent Application No. 1120230117704, 2 pages.
International Search Report with Written Opinion issued Aug. 11, 2021 for PCT Patent Application No. PCT/US2020/065225, 12 pages.
Brazilian Office Action issued Oct. 22, 2025 for BR Patent Application No. 1120230117704, 4 pages.
English Translation of Brazilian Office Action issued Oct. 22, 2025 for BR Patent Application No. 1120230117704, 6 pages.

* cited by examiner

DEPLOYMENT OF UMBILICAL WITH TUBULAR STRING

CROSS-REFERENCE TO RELATED APPLICATION

This application is a national stage under 35 USC 371 of International Application No. PCT/US20/65225, filed on 16 Dec. 2020. The entire disclosure of this prior application is incorporated herein by this reference.

TECHNICAL FIELD

This disclosure relates generally to equipment utilized and operations performed in conjunction with a subterranean well and, in one example described below, more particularly provides for deployment of an umbilical with a tubular string into a well.

BACKGROUND

It is sometimes desirable to deploy an umbilical along with a tubular string into a subterranean well. The umbilical may comprise one or more electrical, fiber optic, hydraulic or other types of lines, and combinations thereof. The umbilical is typically strapped or otherwise clamped to the tubular string as the tubular string is installed in the well.

It will, therefore, be readily appreciated that improvements are continually needed in the art of deploying umbilicals with tubular strings. Such improvements may be useful with a variety of different types of umbilicals and tubular strings.

DETAILED DESCRIPTION

Figure 1:
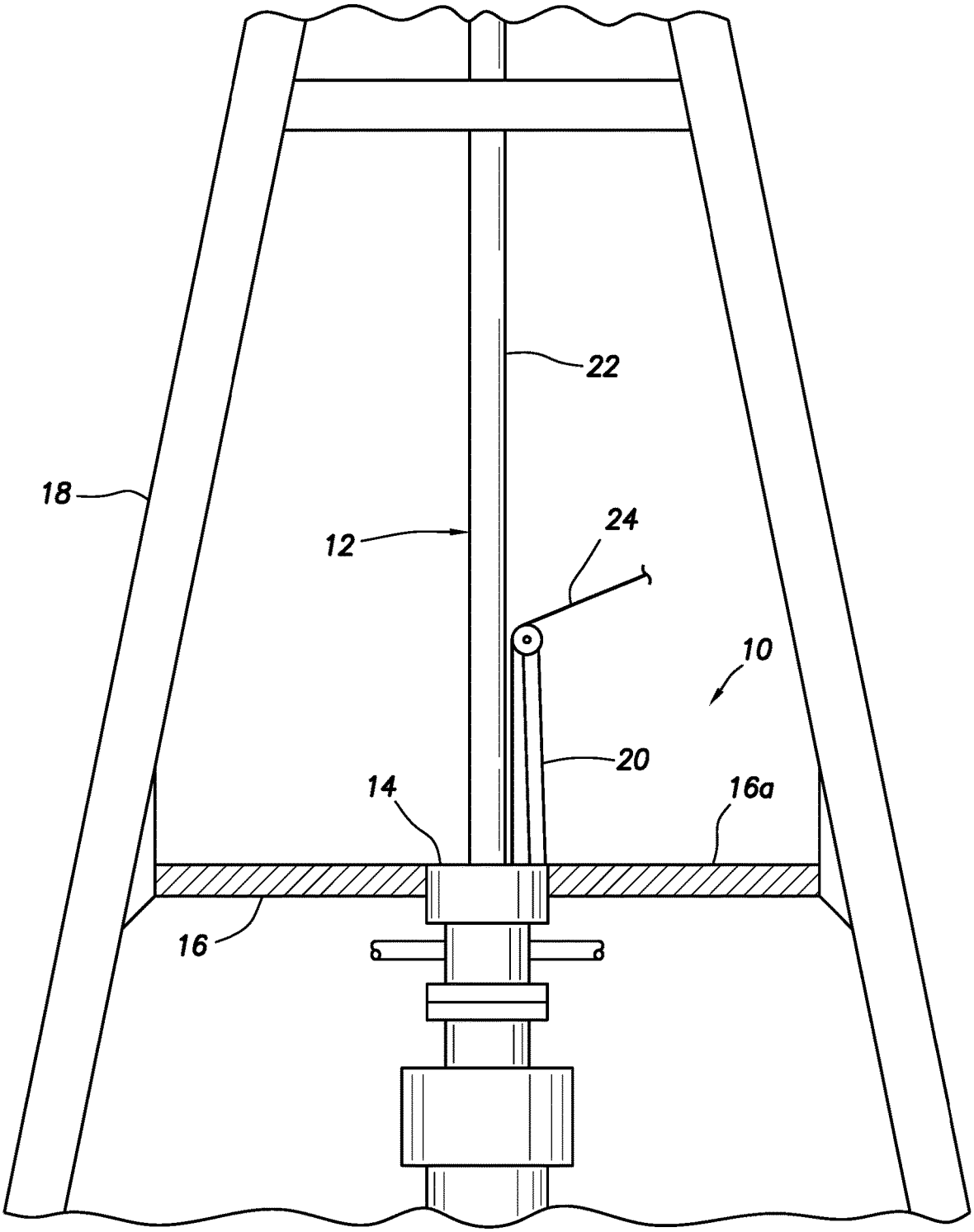
FIG. 1 is a representative partially cross-sectional view of an example of a system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12, which includes multiple sections of pipe 22, is suspended over and in a borehole (not visible in FIG. 1) by a pipe handling hang-off assembly 14. The hang-off assembly 14 is configured to suspend elongate well components (such as, drill pipe, tubing, liner, casing, riser, bottom hole assemblies, other well equipment, etc.). The tubular string 12 could also be suspended by means of an elevator or a top drive in various examples. The scope of this disclosure is not limited to any particular equipment used in conjunction with the hang-off assembly 14.

The hang-off assembly 14 is incorporated into a rig floor 16 of a well rig 18 (such as, a land-based or a water-based drilling rig, etc.). In some examples, an upper surface of the hang-off assembly 14 may be flush with an upper surface 16*a* of the rig floor 16. However, in other examples, the hang-off assembly 14 is not necessarily flush with an upper surface of a rig floor.

As depicted in FIG. 1, the system 10 includes an umbilical deployment apparatus 20. The apparatus 20 is used to guide an umbilical 24 so that it is positioned adjacent the tubular string 12. This facilitates strapping, clamping or otherwise attaching the umbilical 24 to the tubular string 12 as it is lowered into the well. As used herein, the terms "clamp," "clamping" and variations thereof are considered to include straps, strapping and other techniques for securing an umbilical to a tubular string as it is deployed into a well.

The umbilical 24 may comprise one or more electrical, fiber optic, hydraulic or other types of lines, or a combination thereof. The scope of this disclosure is not limited to use of any particular type of umbilical with the deployment apparatus 20.

It would be desirable to be able to attach the umbilical 24 to the tubular string 12 in a manner that prevents interference between the deployment apparatus 20 and tongs or other devices used to apply torque to connections between pipes 22 in the tubular string 12, and that enhances personnel safety. For these purposes and others, the deployment apparatus 20 includes a uniquely configured telescoping arm, as described more fully below.

Figure 2:
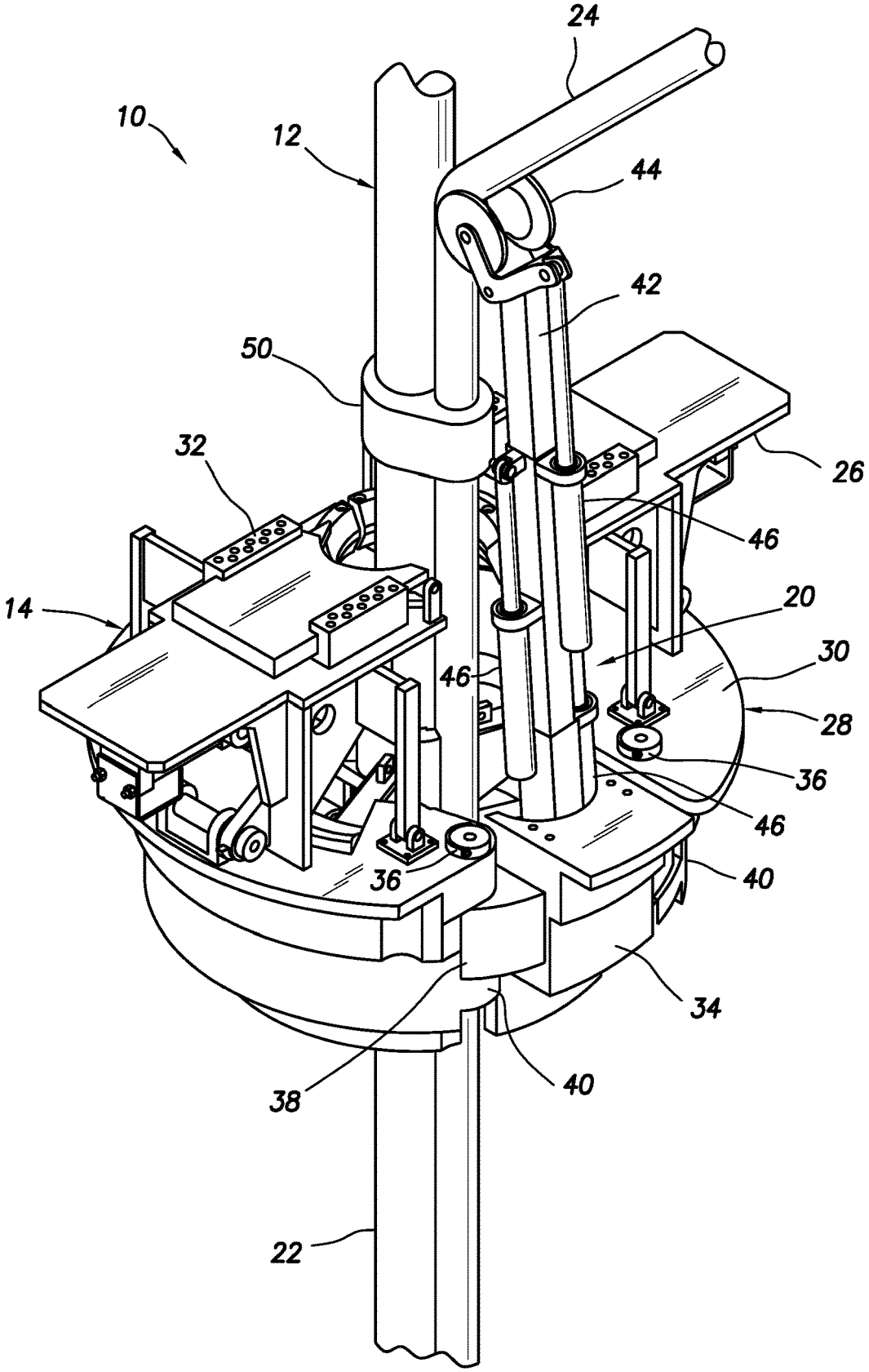
FIG. 2 is a representative perspective view of an example of an umbilical deployment apparatus being used with a hang-off assembly for deployment of an umbilical with a tubular string.

Referring additionally now to FIG. 2, a more detailed perspective view of an example of the deployment apparatus 20 and the hang-off assembly 14 are representatively illustrated during deployment of the tubular string 12 and umbilical 24. The deployment apparatus 20 example depicted in FIG. 2 may be used with the system 10 and method of FIG. 1, or the apparatus may be used with other systems and methods.

In the FIG. 2 example, the hang-off assembly 14 includes a safety stop device 26 positioned above a spider 28. A "spider" is a type of equipment used in well pipe handling operations to grip and suspend a well component above a borehole. A spider may be used with various types of well components, such as, tubular strings (e.g., drill pipe, tubing, pipe, liner, casing, riser, etc.), bottom hole assemblies and other well equipment. A spider typically includes multiple gripping elements (known to those skilled in the art as "slips") arranged in a radial array.

In this example, the hang-off assembly 14 would be mounted in the rig floor 16 with an upper surface 30 of the spider 28 flush with the upper surface 16*a* of the rig floor. Thus, an upper surface 32 of the hang-off assembly 14 (on the safety stop device 26) is positioned above the upper surface 30 of the spider 28.

The deployment apparatus 20 includes a base 34 which is mounted to the spider 28 using fasteners or pins 36. Each of the pins 36 extends through a respective opposite side 38 of the base 34 and a respective opposite circumferential end 40 of the spider 28.

The deployment apparatus 20 also includes a telescoping arm 42. A roller, pulley, sheave, or other means 44 for guiding the umbilical 24 is rotatably connected at an upper end of the telescoping arm 42. A lower end of the telescoping arm 42 (not visible in FIG. 2) is pivotably connected to the base 34 (such as, via a mounting bracket 68 and pivot 70, see FIGS. 5-7).

Actuators 46 are used to extend and retract the telescoping arm 42. In the FIG. 2 example, the actuators 46 are hydraulic cylinders, but other types of actuators may be used in other examples. Three of the actuators 46 are depicted in FIG. 2, but any number of actuators may be used in keeping with the principles of this disclosure.

Another actuator 48 (see FIGS. 5-7) is used to pivot the telescoping arm 42 relative to the base 34 and the hang-off assembly 14. The actuator 48 is not shown in FIG. 2 for clarity, but the actuator 48 is mounted on the base 34 in this example, as described more fully below.

As depicted in FIG. 2, the telescoping arm 42 is in an extended configuration and is pivoted toward the tubular string 12, so that the umbilical 24 is positioned adjacent the tubular string. In this position, a clamp 50 can be conveniently installed to secure the umbilical 24 to the tubular string 12. The tubular string 12, umbilical 24 and clamp 50 can then be lowered into the well through the hang-off assembly 14 (after releasing the slips of the spider 28).

After the tubular string 12, umbilical 24 and clamp 50 are lowered, the slips of the spider 28 can be set (to again suspend the tubular string from the hang-off assembly 14), and the telescoping arm 42 can be retracted and pivoted away from the tubular string 12. In this configuration, an additional pipe 22 can be connected to the upper end of the tubular string 12 and torque can be applied (for example, using power tongs or a top drive). When the connection is fully made-up, the telescoping arm 42 can again be extended and pivoted toward the tubular string 12, and the steps described above can be repeated.

Figure 3:
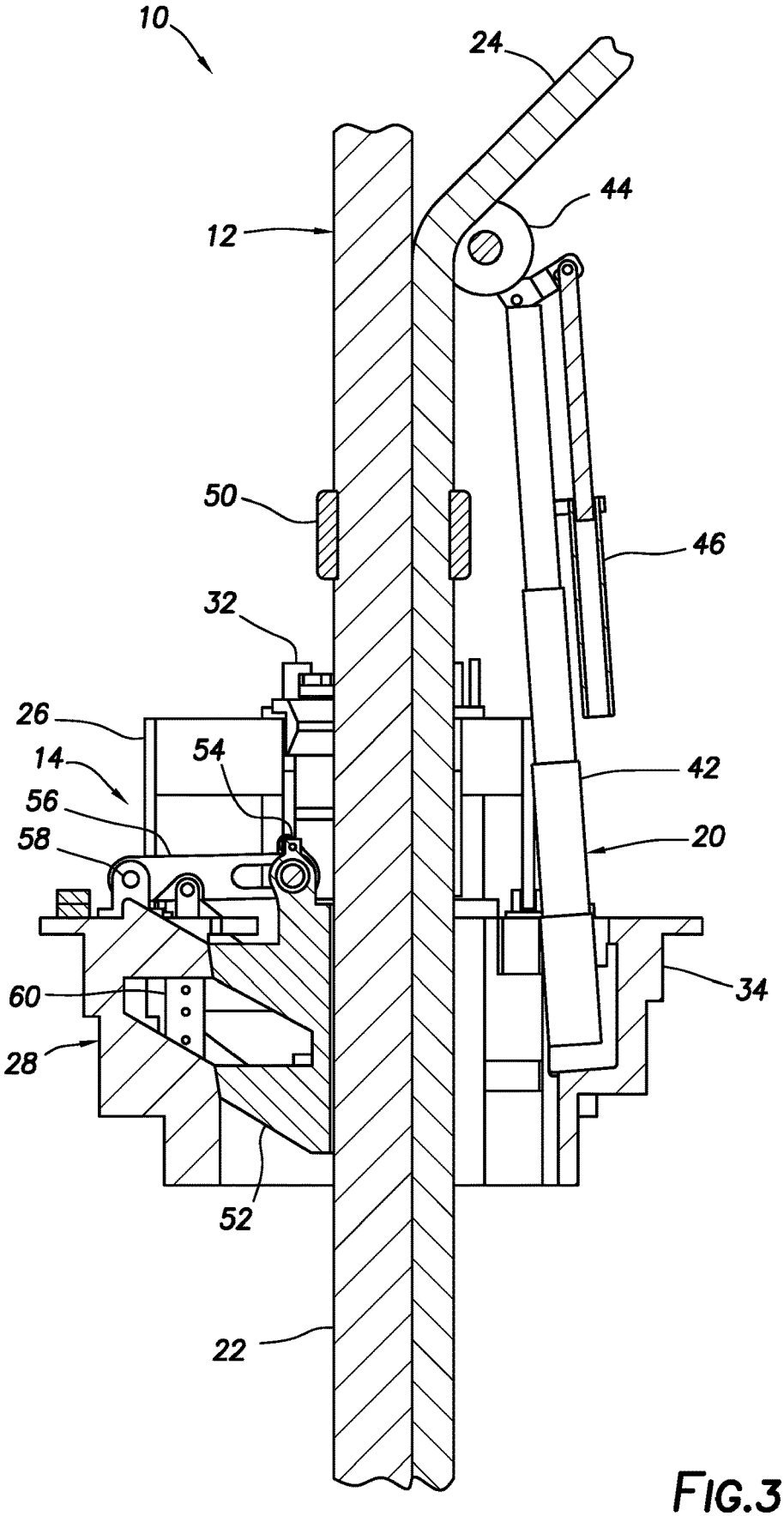
FIG. 3 is a representative cross-sectional view of the apparatus and the hang-off assembly, with a telescoping arm of the apparatus in an extended configuration.

Referring additionally now to FIG. 3, a cross-sectional view of the hang-off assembly 14 and the deployment apparatus 20 with the telescoping arm 42 in the extended configuration is representatively illustrated. In this view, one of the slips 52 of the spider 28 is visible.

The slip 52 is set, so that it grips an outer surface of the tubular string 12. An upper end 54 of the slip 52 is connected to one end of an arm 56. An opposite end of the arm 56 is connected to a pivot 58, and an actuator 60 is used to rotate the arm about the pivot to thereby raise and lower the arm.

Figure 4:
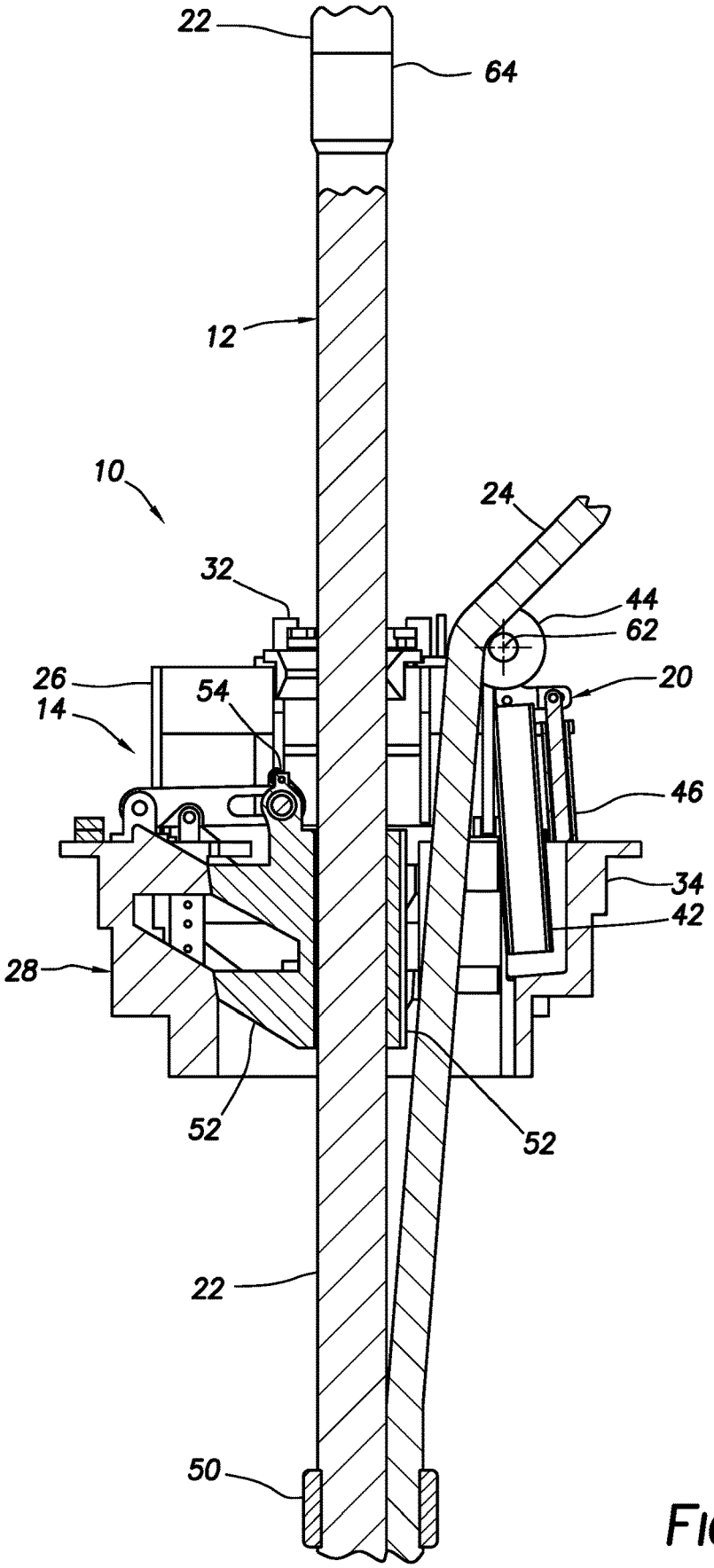
FIG. 4 is a representative cross-sectional view of the apparatus and the hang-off assembly, with the telescoping arm of the apparatus in a retracted configuration.

Referring additionally now to FIG. 4, a cross-sectional view of the hang-off assembly 14 and the deployment apparatus 20 with the telescoping arm 42 in the retracted configuration is representatively illustrated. Note that the tubular string 12, the umbilical 24 and the clamp 50 have been lowered further into the well, as compared to the FIG. 3 configuration.

The telescoping arm 42 is in its retracted configuration. Note that, in this example, an axis of rotation 62 of the guiding means 44 is positioned below the upper surface 32 of the hang-off assembly 14. In this position, the telescoping arm 42 and the umbilical 24 are spaced apart from a connection 64 between the tubular string 12 and another pipe 22 being added to the upper end of the tubular string. As a result, a tong or other torque-applying device can be conveniently used to make-up the connection 64.

After the connection 64 is made-up, the slips 52 of the spider 28 can be released. The tubular string 12 and umbilical 24 can then be lowered further into the well. The telescoping arm 42 can be positioned in the retracted configuration while the tubular string 12 and umbilical 24 are lowered into the well. The telescoping arm 42 may be positioned in the extended configuration only for the clamping operation (e.g., extended prior to the clamp 50 installation, and then retracted after the clamp installation).

In one example method, the following steps are performed in sequence: beginning with the telescoping arm 42 in its retracted configuration, the slips 52 are released and the tubular string 12 is lowered into the well; then the slips are set to suspend the tubular string from the hang-off assembly 14; then a connection 64 is made-up; then the slips are released and the tubular string is lowered further into the well; then the slips are again set to suspend the tubular string; then the telescoping arm is extended and pivoted toward the tubular string; and then the umbilical 24 is secured to the tubular string with the clamp 50. These steps are repeated as additional pipes 22 are added to the tubular string 12.

Figure 5:
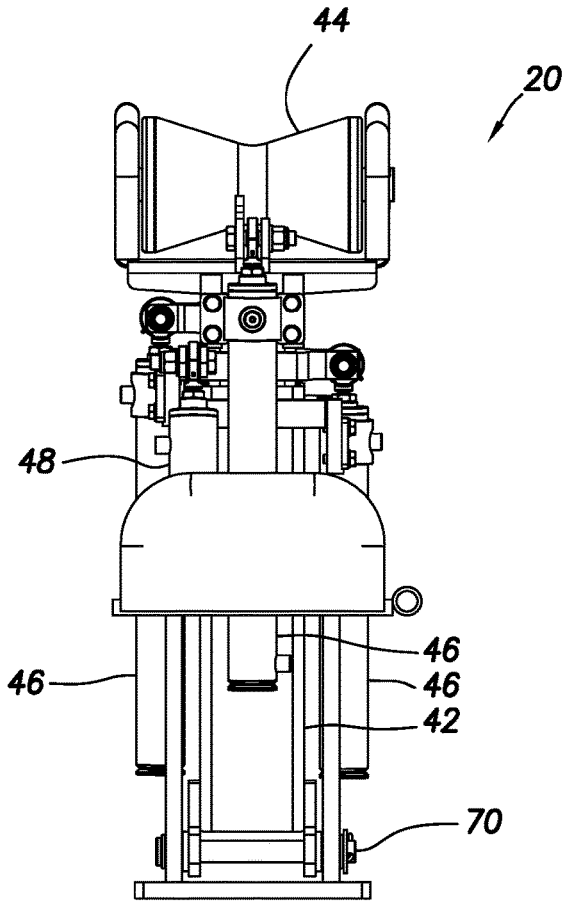
FIG. 5 is a representative elevational view of the apparatus in the retracted configuration.
Figure 6:
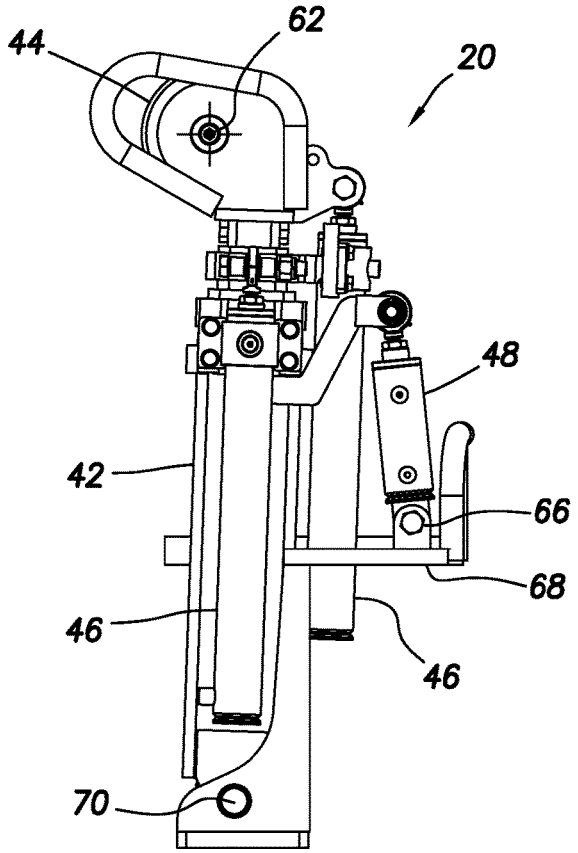
FIG. 6 is a representative side view of the apparatus in the retracted configuration.
Figure 7:
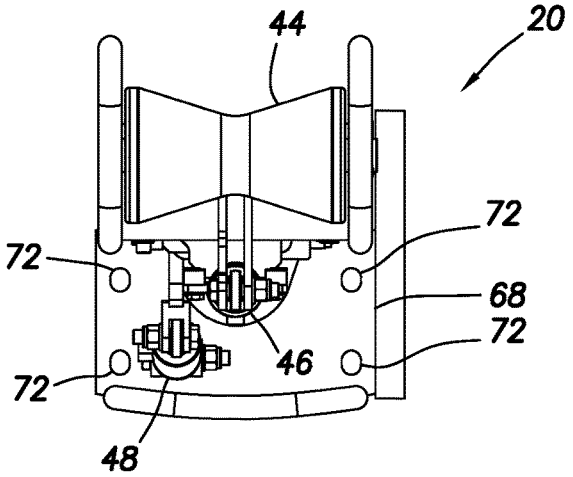
FIG. 7 is a representative top view of the apparatus in the retracted configuration.

Referring additionally now to FIGS. 5-7, elevational, side and top views of another example of the deployment apparatus 20 in the retracted configuration are representatively illustrated. The base 34 is not shown in FIGS. 5-7.

In FIG. 5, it may be seen that three of the actuators 46 are used for extending and retracting the telescoping arm 42. In this example, the telescoping arm 42 includes four sections (see FIG. 8). Each of the actuators 46 is used to extend or retract a respective adjacent pair of the telescoping arm 42 sections. In other examples, other numbers of actuators and telescoping arm sections may be used.

In FIG. 6, it may be seen that the actuator 48 is connected at its lower end to a pivot 66 secured to a mounting bracket 68. An upper end of the actuator 48 is connected to a lowermost section of the telescoping arm 42. Thus, when the actuator 48 is extended the telescoping arm 42 is pivoted toward the tubular string 12 (see FIG. 3), and when the actuator 48 is retracted the telescoping arm is pivoted away from the tubular string.

The telescoping arm 42 rotates about a pivot 70 positioned at a lower end of the mounting bracket 68 when the actuator 48 is extended or retracted. In this example, the telescoping arm 42 is angled two to three degrees away from the tubular string 12 when the actuator 48 is fully retracted, and the telescoping arm can be angled up to approximately six degrees toward the tubular string when the actuator 48 is fully extended. However, other telescoping arm angles may be used in other examples.

The mounting bracket 68 is used to secure the telescoping arm 42 to the base 34 (see FIG. 2), for example, using fasteners extending through the mounting bracket and into threaded holes in the base. With the mounting bracket 68 secured to the base 34, the pivot 70 is positioned below the upper surface 30 of the spider 28 (see FIG. 2), and is positioned below the upper ends 54 of the slips 52 (see FIG. 3). In addition, the pivot 70 is positioned within an outer circumference of the spider 28 (see FIG. 2) when the base 34 is connected between the opposite circumferential ends 40 of the spider. This provides a compact configuration, enabling the apparatus 20 to not interfere with the torquing and make-up of tubular connections 64 (see FIG. 4), while also enabling the apparatus to facilitate installation of the clamp 50 when the telescoping arm 42 is extended and pivoted toward the tubular string 12 (see FIG. 2).

In FIG. 7, it may be seen that the mounting bracket 68 is provided with holes or openings 72 for securing the mounting bracket onto the base 34. In other examples, other techniques may be used to secure the mounting bracket 68 to the base 34. Alternatively, the mounting bracket 68 could be integrally formed with the base 34, if desired.

Figure 8:
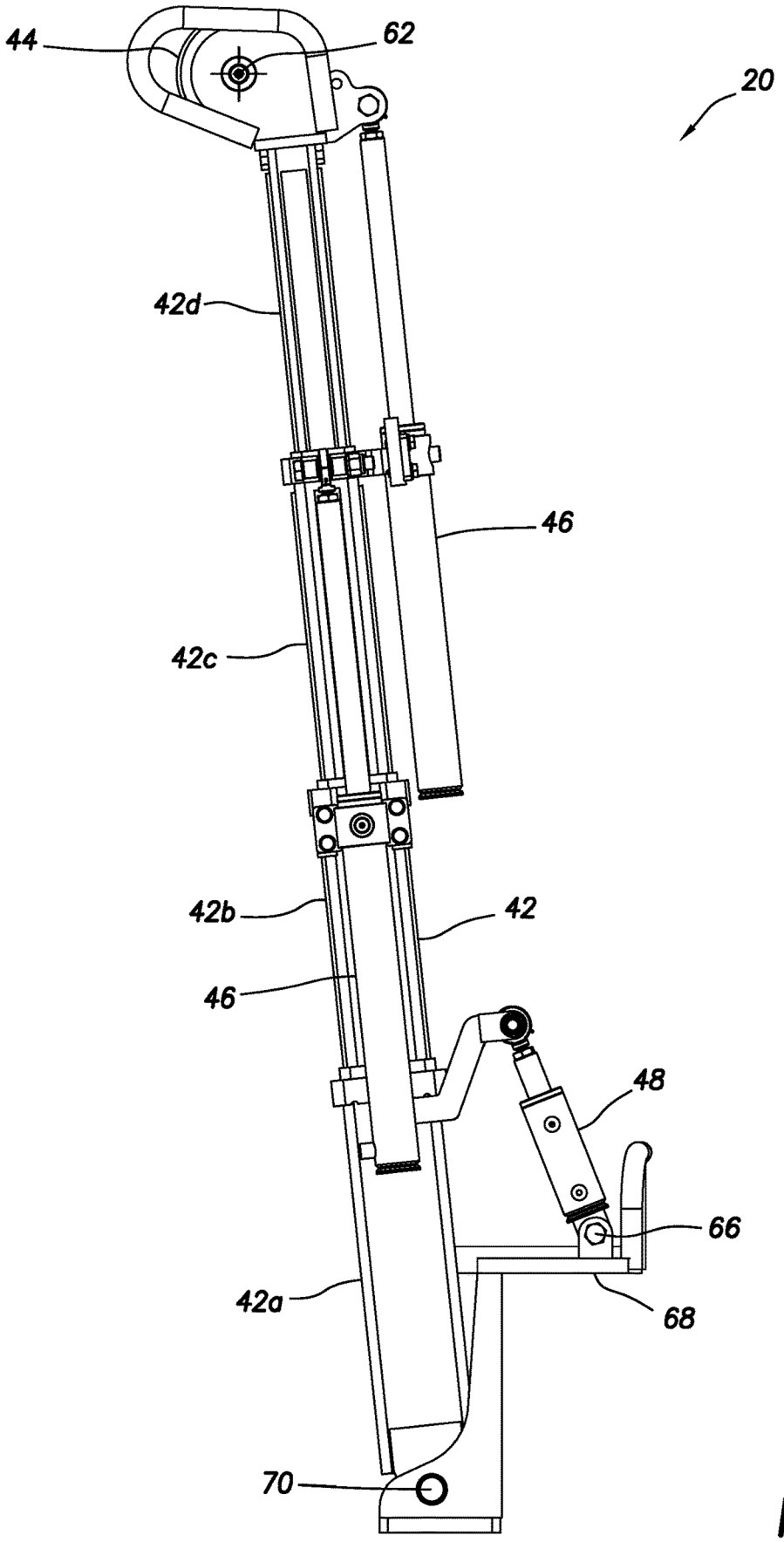
FIG. 8 is a representative side view of the apparatus in the extended configuration.

Referring additionally now to FIG. 8, the apparatus 20 is representatively illustrated with the telescoping arm 42 in its extended configuration. The telescoping arm 42 is also pivoted forward (e.g., toward the tubular string 12, see FIG. 3) by extension of the actuator 48.

In FIG. 8, the four sections 42*a-d* of the telescoping arm 42 are more clearly visible. In this example, pressure is simultaneously applied to all three of the actuators 46, so that the sections 42*b-d* are displaced together (or in no particular order), in order to extend the telescoping arm 42. In other examples, a control system could be used to extend the sections 42*b-d* in a predetermined order, if desired.

It may now be fully appreciated that the above disclosure provides significant advancements to the art of deploying an umbilical with a tubular string into a well. In examples described above, the deployment apparatus 20 can be used to facilitate convenient clamping of the umbilical 24 to the tubular string 12, and to facilitate convenient make-up and torquing of tubular connections 64.

The above disclosure provides to the art an apparatus 20 for deploying an umbilical 24 with a tubular string 12 into a subterranean well. In one example, the apparatus 20 can include: a telescoping arm 42 having a rotatable means 44 for guiding the umbilical 24 at a first end of the telescoping arm 42, and a pivot 70 at a second end of the telescoping arm 42. The telescoping arm 42 is rotatable about the pivot 70 relative to a spider 28 of a hang-off assembly 14. The pivot 70 is secured to the spider 28 (e.g., via the mounting bracket 68 and base 34).

The telescoping arm 42 has an extended configuration and a retracted configuration. An axis 62 of the guiding means 44 may be positioned below an upper surface 32 of the hang-off assembly 14 in the retracted configuration.

The pivot 70 may be positioned below an upper end 54 of a slip 52 of the spider 28. The pivot 70 may be positioned below an upper surface 16*a* of a floor 16 of a well rig 18 in which the hang-off assembly 14 is installed.

The spider 28 has an outer circumference, and the pivot 70 may be positioned within the outer circumference. The spider 28 may have opposite circumferential ends 40, the pivot 70 may rotationally secure the telescoping arm 42 to a base 34, and the base 34 may be secured between the opposite circumferential ends 40 of the spider 28.

A method of deploying an umbilical 24 with a tubular string 12 into a subterranean well is also provided to the art by the above disclosure. In one example, the method can include: extending a telescoping arm 42 upward relative to a floor 16 of a well rig 18; pivoting an upper end of the telescoping arm 42 toward the tubular string 12; then clamping the umbilical 24 to the tubular string 12; lowering the tubular string 12; retracting the telescoping arm 42 and pivoting the upper end of the telescoping arm 42 away from the tubular string 12; and applying torque to a connection 64 in the tubular string 12.

The retracting step may position a rotational axis 62 of a guiding means 44 below an upper surface 32 of a hang-off assembly 14.

The method may include setting slips 52 of a spider 28 of a hang-off assembly 14 after the lowering step and prior to the retracting step.

The method may include releasing the slips 52 after the clamping step and prior to the lowering step.

The method may include pivotably mounting the telescoping arm 42 to a base 34, and securing the base 34 to the spider 28. A pivot 70 at a lower end of the telescoping arm 42 may be positioned below upper ends 54 of the slips 52, and/or may be positioned below an upper surface 16*a* of the well rig floor 16.

The extending step may include applying pressure simultaneously to multiple actuators 46. Each of the multiple actuators 46 may be operative to displace a respective section 42*b-d* of the telescoping arm 42.

A system 10 for deploying an umbilical 24 with a tubular string 12 into a subterranean well is also described above. In one example, the system 10 can include: a telescoping arm 42 having a rotatable means 44 for guiding the umbilical 24 at a first end of the telescoping arm 42, and a pivot 70 at a second end of the telescoping arm 42; the telescoping arm 42 being rotatable about the pivot 70 relative to a spider 28 of a hang-off assembly 14; and an actuator 48 operative to rotate the telescoping arm 42 about the pivot 70, the actuator 48 having first and second opposite ends, the actuator 48 first end being connected to the telescoping arm 42, and the actuator 48 second end being positioned within an outer circumference of the spider 28.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An apparatus for deploying an umbilical with a tubular string into a subterranean well, the apparatus comprising:

a telescoping arm having a rotatable means for guiding the umbilical at a first end of the telescoping arm, and a pivot at a second end of the telescoping arm;

the telescoping arm being rotatable about the pivot relative to a spider of a hang-off assembly; and the pivot being secured to the spider, in which the spider has an outer circumference, and the pivot is positioned within the outer circumference.

2. The apparatus of claim 1, in which the telescoping arm has an extended configuration and a retracted configuration, and an axis of the rotatable means is positioned below an upper surface of the hang-off assembly in the retracted configuration.

3. The apparatus of claim 1, in which the pivot is positioned below an upper end of a slip of the spider.

4. The apparatus of claim 1, in which the pivot is positioned below an upper surface of a floor of a well rig in which the hang-off assembly is installed.

5. The apparatus of claim 1, in which the spider has opposite circumferential ends, the pivot rotationally secures the telescoping arm to a base, and the base is secured between the opposite circumferential ends of the spider.

6. A method of deploying an umbilical with a tubular string into a subterranean well, the method comprising:

extending a telescoping arm upward relative to a floor of a well rig, in which a base of the telescoping arm is positioned within an outer circumference of a spider mounted in the floor of the well rig;

pivoting an upper end of the telescoping arm toward the tubular string;

then clamping the umbilical to the tubular string;

lowering the tubular string;

telescopically retracting the telescoping arm and pivoting the upper end of the telescoping arm away from the tubular string; and applying torque to a connection in the tubular string.

7. The method of claim 6, in which the retracting positions a rotational axis of a guiding means below an upper surface of a hang-off assembly.

8. The method of claim 6, further comprising setting slips of the spider after the lowering and prior to the retracting.

9. The method of claim 8, in which a pivot at a lower end of the telescoping arm is positioned below upper ends of the slips.

10. The method of claim 8, further comprising releasing the slips after the clamping and prior to the lowering.

11. The method of claim 6, in which the telescoping arm is pivotably mounted to the base.

12. The method of claim 6, in which a pivot at a lower end of the telescoping arm is positioned below an upper surface of the well rig floor.

13. The method of claim 6, in which the extending comprises applying pressure simultaneously to multiple actuators.

14. The method of claim 13, in which each of the multiple actuators is operative to displace a respective section of the telescoping arm.

15. A system for deploying an umbilical with a tubular string into a subterranean well, the system comprising:

a telescoping arm having a rotatable means for guiding the umbilical at a first end of the telescoping arm, and a pivot at a second end of the telescoping arm;

the telescoping arm being rotatable about the pivot relative to a spider of a hang-off assembly; and an actuator operative to rotate the telescoping arm about the pivot, the actuator having first and second opposite ends, the actuator first end being connected to the telescoping arm, and the actuator second end being positioned within an outer circumference of the spider.

16. The system of claim 15, in which the telescoping arm has an extended configuration and a retracted configuration, and a rotational axis of the rotatable means is positioned below an upper surface of the hang-off assembly in the retracted configuration.

17. The system of claim 15, in which the pivot is positioned below an upper end of a slip of the spider.

18. The system of claim 15, in which the pivot is positioned below an upper surface of a floor of a well rig.

19. The system of claim 15, in which the spider has opposite circumferential ends, the pivot rotationally secures the telescoping arm to a base, and the base is secured between the opposite circumferential ends of the spider.

* * * * *